US006705026B1

(12) United States Patent
Arbour

(10) Patent No.: US 6,705,026 B1
(45) Date of Patent: Mar. 16, 2004

(54) DANCE SHOE

(76) Inventor: Tracy A. M. Arbour, 47205 Scarlet Dr., South, Novi, MI (US) 48374

( * ) Notice: Subject to any disclaimer, the term of this patent is extended or adjusted under 35 U.S.C. 154(b) by 28 days.

(21) Appl. No.: 10/103,399

(22) Filed: Mar. 21, 2002

(51) Int. Cl.[7] ..... A43B 5/12; A43B 19/00

(52) U.S. Cl. ..... 36/8.3; 36/71; 36/77 R; 36/88

(58) Field of Search ..... 36/8.3, 77 R, 88, 36/71, 93, 3 A

(56) References Cited

U.S. PATENT DOCUMENTS

| | | | | | |
|---|---|---|---|---|---|
| 1,436,463 | A | * | 11/1922 | Silver | 36/10 |
| 1,704,281 | A | * | 3/1929 | Capezio | 36/8.3 |
| 1,953,659 | A | * | 4/1934 | Savino | 36/8.3 |
| 2,191,906 | A | * | 2/1940 | Daniels | 12/142 V |
| 2,810,214 | A | * | 10/1957 | Wolfe | 36/8.3 |
| 4,369,284 | A | | 1/1983 | Chen | 524/476 |
| 4,618,213 | A | | 10/1986 | Chen | 350/96.34 |
| 5,098,421 | A | * | 3/1992 | Zook | 604/367 |
| 5,262,468 | A | | 11/1993 | Chen | 524/476 |
| 5,740,618 | A | * | 4/1998 | Minden | 36/8.3 |
| 5,985,383 | A | * | 11/1999 | Allen et al. | 428/34.1 |
| 2001/0007180 | A1 | * | 7/2001 | Bordin | 36/93 |

FOREIGN PATENT DOCUMENTS

| | | | |
|---|---|---|---|
| EP | 0136415 | * | 7/1984 |
| EP | 0931469 | * | 7/1999 |

* cited by examiner

*Primary Examiner*—M. D. Patterson
(74) *Attorney, Agent, or Firm*—Rader, Fishman & Grauer, PLLC

(57) ABSTRACT

A dance shoe is provided that includes a flexible upper and a toe box configured to surround at least a portion of a dancer's foot. The dance shoe further includes a viscoelastic padding layer that is provided between the toe box and the dancer's foot to shield the foot from the rigidity of the toe box. The viscoelastic padding layer dissipates the pressure and friction exerted upon the dancer's foot, particularly when the dancer is executing a "sur le pointe" dance step, without decreasing the dancer's ability to "feel" the floor. The viscoelastic padding layer is also capable of lubricating, softening and medicating the dancer's foot. The viscoelastic padding layer may also be used in other areas of the shoe to provide additional comfort for the dancer.

19 Claims, 3 Drawing Sheets

DANCE SHOE

BACKGROUND OF THE INVENTION

1. Field of the Invention

The present invention relates generally to the field of dance shoes and, more particularly, to a ballet shoe.

2. Description of the Related Art

The art of ballet first originated in ancient Rome and developed into a formal dance set to music during the Renaissance period. In the early 1800's, ballet underwent a remarkable change characterized by the requirement that dancers appear to float gracefully through the air. To create this aura, dancers rise on their toes in a dance step known as "sur le pointe." The hallmark of a ballerina is her ability to personify her graceful movements while "en pointe."

In the "sur le pointe" dance step, nearly all of the contact force with the floor passes through the dancer's foot, especially the toes, which must not deflect forward, backward or sideways. Specially designed ballet shoes, known as pointe shoes or toe shoes, have been developed to support a dancer's foot while "en pointer"Pointe shoes generally comprise a flexible upper that covers the front of the foot and extends on either side of the instep and around the heel of the foot. The front of the upper typically overlays a rigid toe box or "vamp" adapted to surround the front part of the foot and protect the foot while "en pointe." Dancers have generally been reluctant to place padding between the forefoot area and the toe box of the ballet shoe because it reduces a dancers ability to "feel" the floor and to articulate the forefoot, both of which are essential to speed and balance. The compression of the dancer's foot against the rigid toe box of the ballet shoe while a dancer is "en pointe" causes numerous injuries to the foot, including fractured metatarsal bones, plantar facitis, sesmoiditis, tendinitis and hallus nail trauma to name a few.

Accordingly, there exists a need for a dance shoe, more particularly a pointe shoe, which reduces the likelihood of injury to a dancer without limiting the dancer's ability to "feel" the floor and articulate the forefoot while the dancer is "en point."

SUMMARY OF THE INVENTION

In accordance with an embodiment of the present invention, a dance shoe is provided that includes a flexible upper and a toe box configured to surround at least a portion of a dancer's foot. The dance shoe further includes a viscoelastic padding layer that is provided between the toe box and the dancer's foot to shield the foot from the rigidity of the toe box.

In a preferred embodiment of the present invention, the viscoelastic padding layer comprises a thermoplastic gel. The thermoplastic gel dissipates the pressure and friction exerted upon a dancer's foot, particularly when the dancer is executing a "sur le pointe" dance step. The viscoelastic gel may include at least one of a lubricating oil and a medicinal agent to soften and medicate the dancer's foot.

The present invention is particularly useful for padding and medicating the feet of a ballet dancer who routinely executes the "sur le pointe" dance step. Among other advantages, the invention dissipates the pressure and friction exerted upon a dancer's foot without decreasing the dancer's ability to "feel" the floor. Another advantage is that the present invention is capable of lubricating, softening and medicating a dancer's foot. Yet another advantage of the present invention is that the padding layer conforms to the shape of the foot without the need to pre-shape the padding layer during manufacture. Still yet another advantage of the present invention is that the padding layer dissipates the pressure forces on a dancer's foot in a manner that does not interfere with circulation in the foot.

DESCRIPTION OF THE PREFERRED EMBODIMENT

Figure 1:
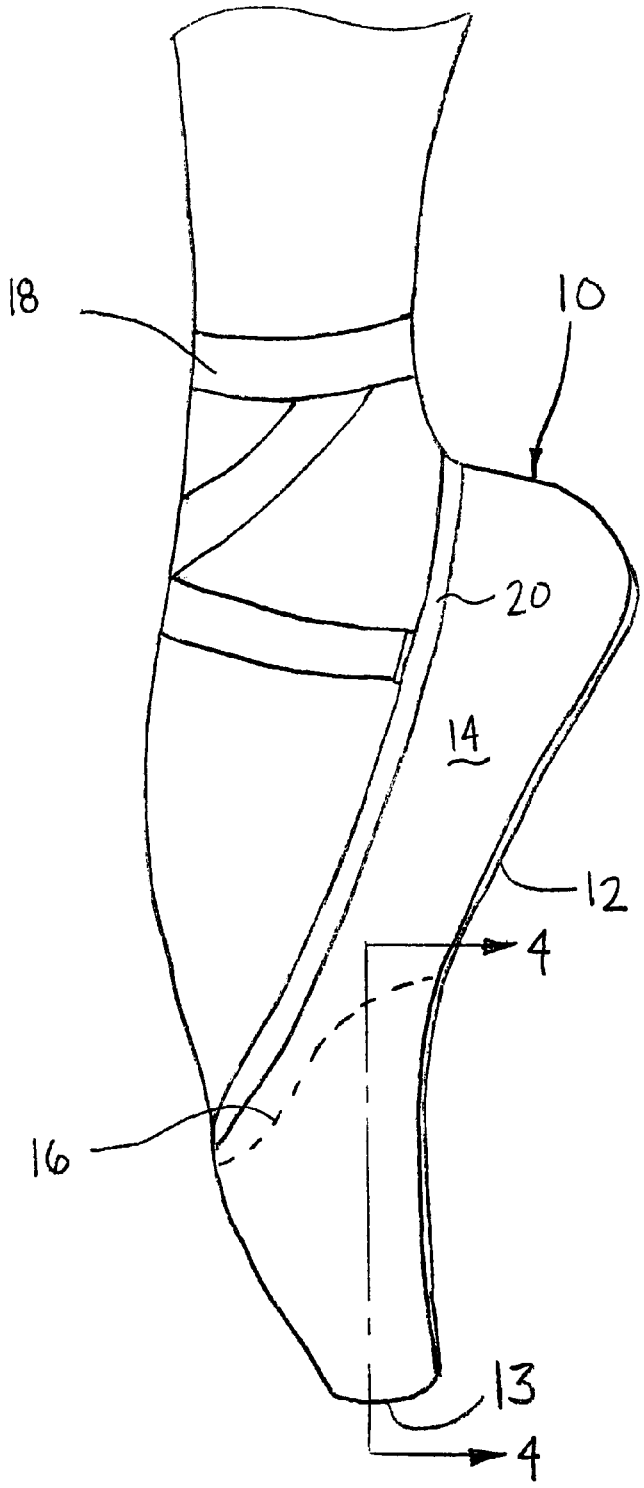
FIG. 1 is a side view of a dancer's foot in the "pointe" position wearing the dance shoe of the present invention.
Figure 2:
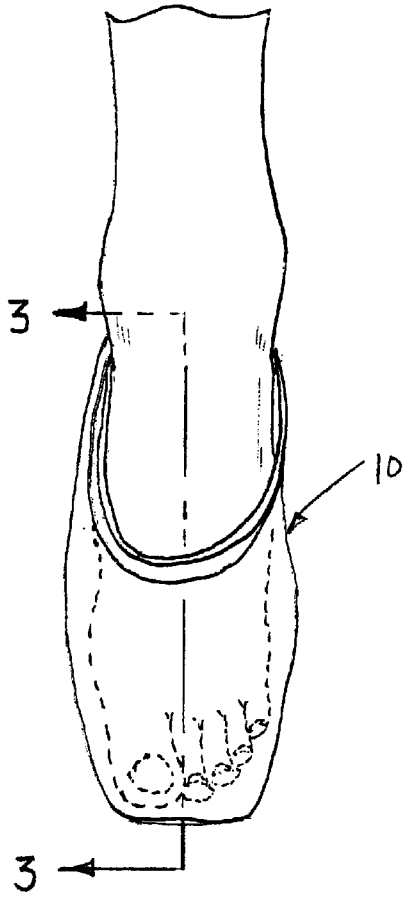
FIG. 2 is a front elevational view of the dance shoe of FIG. 1 with the dancer's foot shown in phantom outline.

Referring now to the drawings, the various embodiments of the present invention are described in detail. Referring to FIGS. 1 and 2, a foot of a dancer executing a "sur le pointe" dance step is shown wearing a dance shoe 10 that is of the "pointe" or "toe" type. Dance shoe 10 generally includes an outer sole 12 to which is joined a flexible upper 14 that covers the toes of the dancer and extends along either side of the instep and around the heel. Inside an anterior end 13 of upper 14 is a vamp or toe box 16, shown hidden in FIG. 1, whose rigidity firmly supports the front portion of the dancer's foot during the "sur le pointe" dance step. Fabric straps 18 may be stitched to a neck or border 20 of flexible upper 14 and may be tied around the ankle of the dancer while wearing dance shoe 10.

Figure 3:
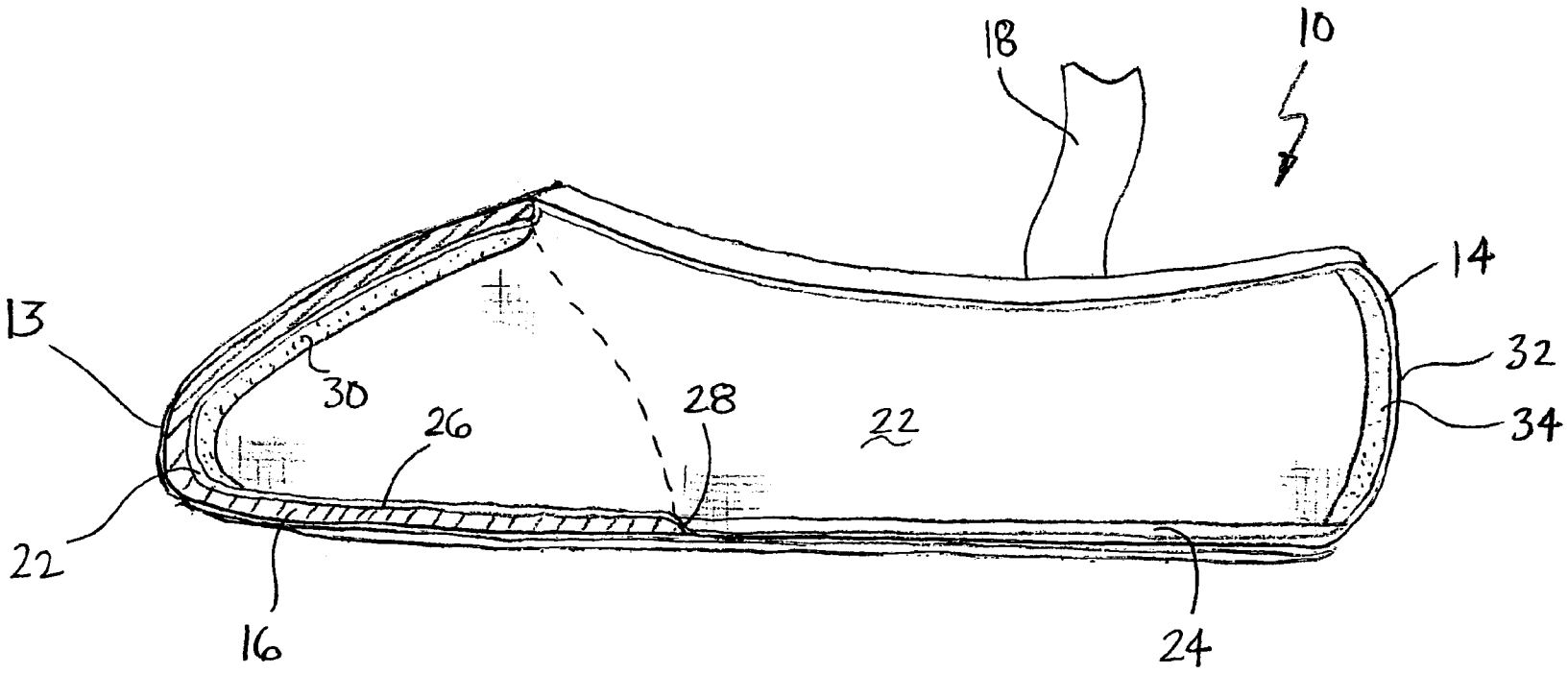
FIG. 3 is a cross-sectional view of the dance shoe along line 2—2 in FIG. 2.

Referring to FIG. 3, the flexible upper 14, which is typically made of satin, and the toe box or vamp 16, which typically comprises a hardened laminate, is preferably lined with a fabric 22. Fabric 22 is preferably a soft material such as cotton, and may exhibit a moisture absorbing property to facilitate the absorption of perspiration and a reduction in odor. Toe box 16 defines an inner surface 26 that is covered by and preferably adhered to fabric 22. An insole 24 is fixed to the inside of upper 14 and extends from the heel of dance shoe 10 to as far as an end 28 of toe box 16. Optionally, an intermediate stiffening member or shank (not illustrated) may be disposed between outer sole 12 and insole 18 to stiffen the shoe longitudinally. The above-described structure of dance shoe 10 is given by way of example only and is not intended to limit the scope of this invention.

In a preferred embodiment of the present invention, a padding layer 30 is provided over at least a portion of the inner surface 26 of toe box 16 such that fabric 22 is sandwiched therebetween. Padding layer 30 is preferably a viscoelastic, incompressible, polymeric material that exhibits pressure dissipating properties and the ability to internally absorb frictional or horizontal shear forces encountered as the dancer's foot slides forward in dance shoe 10. In other words, padding layer 30 is provided to shield a dancer's foot from the rigidity of toe box 16 while the dancer is "en pointe."

While padding layer 30 is described and illustrated as shielding the dorsal, medial and lateral aspects of the dancer's foot from toe box 16, it may also be used to protect other areas of the dancer's foot. For example, as illustrated in FIG. 3, a posterior end 32 of flexible upper 14 may include a viscoelastic padding layer 34, positioned so as to be adjacent a heel of the dancer's foot.

Figure 4:
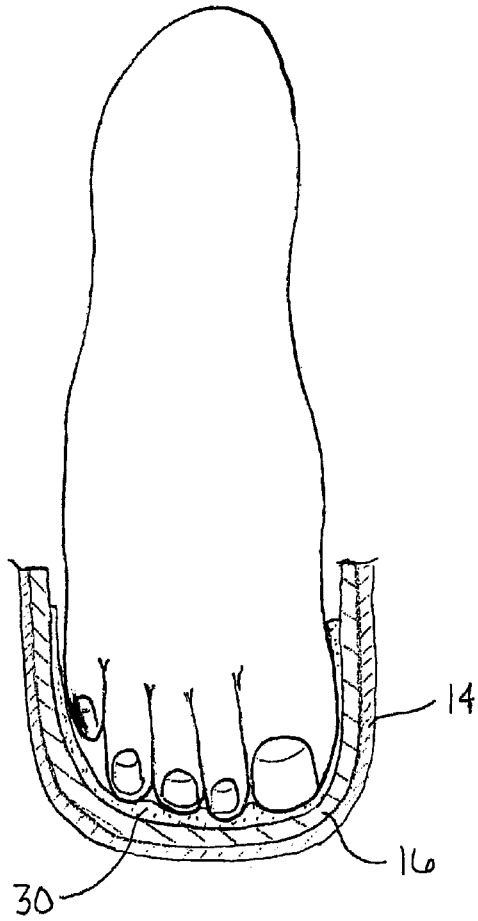
FIG. 4 is a frontal cross-sectional view along the line 4—4 in FIG. 1 showing the dancer's foot in contact with a padding layer.

Padding layer 30 may be substantially uniform in thickness, as illustrated in FIGS. 3 and 4, or may exhibit a variable thickness or even zero thickness where a void is desired in padding layer 30. Because the dancer's foot will apply slight pressure on the deformable padding layer 30, padding layer 30 will spontaneously assume the surface configuration of the of the dancer's foot, thus eliminating the need to substantially shape padding layer 30 during manufacture. A padding layer 30 thickness on the order of approximately 1–2 mm is generally sufficient to provide adequate pressure dissipation and frictional absorption to the digits and metahead areas of the dancer's foot. However, the thickness of padding layer 30 will depend greatly on various factors including, but not limited to, the physical properties of the padding layer material and a dancer's particular level of comfort. While increasing the thickness of padding layer 30 generally improves comfort, it also reduces the dancer's ability to "feel" the floor and to articulate the forefoot, both of which are essential to speed and balance.

An exemplary material for use in padding layer 30 is the ultrasoft thermoplastic gelatinous composition taught by Chen in U.S. Pat. No. 4,369,284, which is incorporated by reference herein in its entirety. The viscoelastic properties of a thermoplastic gel allow padding layer 30 to behave like a fluid when the pressure of the dancer's foot is applied. This pressure is substantially uniformly dissipated throughout the viscoelastic material in a "hydraulic" manner similar to the way pressure is distributed through the braking system of an automobile when pressure is applied to the brake pedal. In response to the applied pressure, the viscoelastic gel will "flow" over the contours of the dancer's foot so as to substantially equalize pressure over the surface of the dancer's foot in a manner superior to conventional padding materials, such as compressible felt, lambs wool or foam rubber. Thus, when pressure is applied to padding layer 30, such as during a "sur le pointe" dance step, the surface area of padding layer 30 will expand and distribute the applied pressure over a greater area. The incompressible gel also dissipates pressure forces on the dancer's foot in a manner that does not interfere with circulation in the foot. Another feature of the present invention is the ability of padding layer 30 to absorb frictional or shearing forces without substantially sliding forward and backward on the dancer's foot. For example, the exemplary viscoelastic gel taught by Chen in U.S. Pat. No. 4,369,284 is capable of being stretched to approximately 1600% of its original length before tearing. For the sake of illustration, assume dance shoe 10 is provided with an approximately 1.0 mm thick padding layer 30 comprising the Chen viscoelastic gel material. When a shearing force is applied substantially parallel to the surface of padding layer 30, the surface is displaced laterally as the viscoelastic gel stretches. A 1.0 mm thick layer of such material could therefore be displaced 1.0×16, or nearly 16 mm in one direction. The ability of padding layer 30 to easily dissipate frictional or shearing forces even when utilized in a thin layer is particularly advantageous in the narrow confines of dance shoe 10.

Another feature of padding layer 30, although not a requirement, is its capability to deliver a therapeutically significant amount of lubricating oil, such as mineral oil, to soften the skin of the dancer. The application of mineral oil is particularly advantageous when the dancer's foot suffers from corns, calluses or other keratotic lesions. Padding layer 30 may also be capable of delivering a medicinal agent, such as a keratolytic agent, an antifungal, an antibacterial agent or any other pharmacological agent that would be beneficial to the dancer's skin. The medicinal agent could be suspended in the matrix of the polymer matrix of padding layer 30. Alternatively, the lubricating oil may be perfused with an oil soluble medicinal agent. Still another feature of padding layer 30 is that it may be fenestrated to ventilate or otherwise reduce moisture build-up between padding layer 30 and the dancer's foot.

Viscoelastic materials, like the Chen thermoplastic gel, generally need to be secured to prevent the viscoelastic material from "balling-up" or otherwise migrating. Left unsecured, the repeated application and removal of pressure would cause the gel to be squeezed away from the area of high pressure to an area of low pressure. Therefore, padding layer 30 is preferably secured to fabric 22 by impregnating the viscoelastic material into the weaving of fabric 22. Because the exemplary viscoelastic gel taught by Chen in U.S. Pat. No. 4,369,284 is a thermoplastic, it may be impregnated into fabric 22 by simply heating the viscoelastic gel to a temperature that converts the gel into a free-flowing liquid. The liquefied gel may then be poured onto fabric 22 and allowed to cool and re-gel. While in the heated state, the liquefied gel will penetrate fabric 22, become partially absorbed by fabric 22 and encapsulate at least a portion of the woven fibers of fabric 22 when the gel cools. It will be appreciated that padding layer 30 may also be secured to fabric 22 using other methods including, but not limited to, gluing or otherwise adhering padding layer 30 to fabric 22.

The above description concerning the material composition of padding layer 30 should not be construed as a limitation on the scope of the invention, but rather as an exemplification of a preferred embodiment thereof. For example, materials that do not fall within the specific definition of a "gel," but which have substantially similar physical properties, such as being highly deformable, ultrasoft and incompressible, could be utilized in place of the viscoelastic gel taught in Chen. For example, a polymeric compound that "sets-up" or cures after mixing or, alternatively, a polymeric compound that cures upon exposure to air or heat could also be utilized in the present invention.

Additionally, the above-described viscoelastic padding layer 30 may be advantageously employed in other types of dance shoes, such as a tap dance shoe and the like, to dissipate pressure and friction, lubricate, soften and medicate a dancer's foot. In this respect, padding layer 30 may be employed in other areas of a dance shoe besides those areas listed above, such as the plantar aspect of a dancer's foot.

Thus, it will be appreciated that the present invention is useful for padding the feet of a dancer, particularly a dancer who routinely executes the "sur le pointe" dance step. Among other advantages, the invention dissipates the pressure and friction exerted upon a dancer's foot without decreasing the dancer's ability to "feel" the floor. Another advantage is that the present invention is capable of lubricating, softening and medicating a dancer's foot. Yet another advantage of the present invention is that the padding layer conforms to the shape of the foot without the need to pre-shape the padding layer during manufacture. Still yet another advantage of the present invention is that the padding layer dissipates the pressure forces on a dancer's foot in a manner that does not interfere with circulation in the foot.

Although certain preferred embodiments of the present invention have been described, the invention is not limited to the illustrations described and shown herein, which are deemed to be merely illustrative of the best modes of carrying out the invention. A person of ordinary skill in the art will realize that certain modifications and variations will come within the teachings of this invention and that such variations and modifications are within its spirit and the scope as defined by the claims.

What is claimed is:

1. An article of footwear comprising:

a flexible upper configured to surround at least a portion of a wearer's foot, a fabric lining positioned inwardly of the flexible upper; and a viscoelastic padding layer secured to the fabric lining and positioned to contact the wearer's foot to shield the foot from the flexible upper.

2. A dance shoe comprising:

a flexible upper;

a toe box configured to surround at least a portion of a dancer's foot;

a fabric lining; and a viscoelastic padding layer secured to the fabric lining and positioned to contact the dancer's foot to shield the foot from the toe box.

3. The dance shoe of claim 2, wherein the viscoelastic padding layer is a viscoelastic gel.

4. The dance shoe of claim 3, wherein the viscoelastic gel is thermoplastic in nature.

5. The dance shoe of claim 3, wherein the viscoelastic gel includes a lubricating oil.

6. The dance shoe of claim 5, wherein the lubricating oil is mineral oil.

7. The dance shoe of claim 5, wherein the lubricating oil is perfused with at least one oil soluble medicinal agent.

8. The dance shoe of claim 2, wherein the viscoelastic padding layer includes at least one medicinal agent.

9. The dance shoe of claim 8, wherein the medicinal agent is suspended in the matrix of the viscoelastic padding layer.

10. The dance shoe of claim 8, wherein the medicinal agent comprises at least one of a keratolytic agent, an antifungal and an antibacterial agent.

11. The dance shoe of claim 1, wherein the fabric lining exhibits moisture-absorbing properties.

12. The dance shoe of claim 2, wherein the viscoelastic padding layer is secured to the fabric lining by impregnating the fabric lining with the viscoelastic padding layer.

13. The dance shoe of claim 2, wherein the viscoelastic padding layer is fenestrated to ventilate the foot.

14. The dance shoe of claims wherein the viscoelastic padding layer exhibits a substantially uniform thickness.

15. The dance shoe of claim 2, wherein the viscoelastic padding layer varies in thickness.

16. The dance shoe of claim 2, wherein the flexible upper includes an anterior end and a posterior end, the posterior end including a viscoelastic padding layer positioned so as to be adjacent a heel of the dancer's foot.

17. The dance shoe of claim 2, wherein the viscoelastic padding layer is positioned to shield the digits and metahead areas of the foot from the toe box.

18. A dance shoe comprising:

a flexible upper having an anterior end and a posterior end;

a toe box received in the anterior end of the flexible upper, the toe box configured to surround at least a portion of a dancer's foot;

a fabric lining disposed inwardly of the flexible upper and the toe box;

a padding layer covering at least a portion of the anterior end inwardly of the toe box and at least a portion of the posterior end adjacent a heel of the dancer's foot; and wherein the padding layer is secured to the fabric lining and positioned to contact the dancer's foot.

19. A dance shoe comprising:

a flexible upper;

a toe box covered by the flexible upper and configured to surround at least a portion of a dancer's foot;

a fabric lining positioned inwardly of the flexible upper and the toe box;

a padding layer positioned to shield the foot from the toe box, the padding layer comprising a viscoelastic material that includes at least one of a lubricating oil and a medicinal agent; and wherein the padding layer is to impregnated in the fabric lining and positioned to contact the dancer's foot.

* * * * *

UNITED STATES PATENT AND TRADEMARK OFFICE

CERTIFICATE OF CORRECTION

PATENT NO. : 6,705,026, B1
DATED : March 16, 2004
INVENTOR(S) : Tracey Arbour

It is certified that error appears in the above-identified patent and that said Letters Patent is hereby corrected as shown below:

Column 5,
Line 44, please change "[1]" to -- 2 --.

Column 6,
Line 6, please change "claims" to -- claim 1, --.
Line 41, please remove "to".

Signed and Sealed this

Twenty-fifth Day of May, 2004

JON W. DUDAS
*Acting Director of the United States Patent and Trademark Office*